US006480610B1

(12) United States Patent
Fang et al.

(10) Patent No.: US 6,480,610 B1
(45) Date of Patent: Nov. 12, 2002

(54) SUBBAND ACOUSTIC FEEDBACK CANCELLATION IN HEARING AIDS

(75) Inventors: Xiaoling Fang, Salt Lake City, UT (US); Gerald Wilson, Salt Lake City, UT (US); Brad Giles, Salt Lake City, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 0 days.

(21) Appl. No.: 09/399,483

(22) Filed: Sep. 21, 1999

(51) Int. Cl.[7] ..... H04R 25/00

(52) U.S. Cl. ..... 381/321; 381/318; 381/94.3

(58) Field of Search ..... 381/317, 318, 381/320, 321, 83, 93, 94.1, 94.2, 94.3, 98

(56) References Cited

U.S. PATENT DOCUMENTS

| | | | | |
|---|---|---|---|---|
| 3,578,913 | A | 5/1971 | Ufkes | 179/1 |
| 3,685,009 | A | 8/1972 | Fleming, Jr. | 340/16 R |
| 3,928,733 | A | 12/1975 | Hueber | 179/107 R |
| 4,025,721 | A | 5/1977 | Graupe et al. | 179/1 P |
| 4,061,875 | A | 12/1977 | Freifeld et al. | 179/1 P |
| 4,135,590 | A | 1/1979 | Gaulder | 179/1 P |
| 4,185,168 | A | 1/1980 | Graupe et al. | 179/1 P |
| 4,187,472 | A | 2/1980 | Yum | 330/260 |
| 4,188,667 | A | 2/1980 | Graupe et al. | 364/724 |
| 4,216,430 | A | 8/1980 | Amazawa et al. | 455/219 |
| 4,238,746 | A | 12/1980 | McCool et al. | 333/166 |
| 4,243,935 | A | 1/1981 | McCool et al. | 324/77 R |
| 4,326,172 | A | 4/1982 | Schmidt | 330/294 |
| 4,355,368 | A | 10/1982 | Zeidler et al. | 364/728 |
| 4,368,459 | A | 1/1983 | Sapora | 340/407 |
| 4,548,082 | A | 10/1985 | Engebretson et al. | 73/585 |

(List continued on next page.)

FOREIGN PATENT DOCUMENTS

| | | | |
|---|---|---|---|
| EP | 0 064 042 | 1/1986 | H04R/25/00 |
| EP | 0 823 829 | 11/1998 | H04R/25/00 |
| EP | 0 930 801 | 12/1998 | H04R/3/02 |
| WO | WO 96/35314 | 11/1996 | H04R/25/00 |
| WO | WO 97/50186 | 12/1997 | |
| WO | 98/28943 | 7/1998 | H04R/25/00 |
| WO | WO 98/47227 | 10/1998 | |
| WO | WO 98/47314 | 10/1998 | H04R/25/00 |
| WO | 99/26453 | 5/1999 | H04R/25/00 |

OTHER PUBLICATIONS

Boll, S., "Suppression of Acoustic Noise in Speech Using Spectral Subtraction," Apr. 1979, IEEE Trans. on ASSP, vol. ASSP–27, pp. 113–120.

Brey, Robert H. et al., "Improvement in Speech Intelligibility in Noise Employing an Adaptive Filter with Normal and Hearing–Impaired Subjects," Journal of Rehabilitation Research and Development, vol. 24, No. 4, pp. 75–86.

(List continued on next page.)

*Primary Examiner*—Curtis Kuntz
*Assistant Examiner*—P. Dabney
(74) *Attorney, Agent, or Firm*—Thelen Reid & Priest LLP

(57) ABSTRACT

A new subband feedback cancellation scheme is proposed, capable of providing additional stable gain without introducing audible artifacts. The subband feedback cancellation scheme employs a cascade of two narrow-band filters $A_i(Z)$ and $B_i(Z)$ along with a fixed delay, instead of a single filter $W_i(Z)$ and a delay to represent the feedback path in each subband. The first filter, $A_i(Z)$, is called the training filter, and models the static portion of the feedback path in $i^{th}$ subband, including microphone, receiver, ear canal resonance, and other relatively static parameters. The training filter can be implemented as a FIR filter or as an IIR filter. The second filter, $B_i(Z)$, is called a tracking filter and is typically implemented as a FIR filter with fewer taps than the training filter. This second filter tracks the variations of the feedback path in the $i^{th}$ subband caused by jaw movement or objects close to the ears of the user.

24 Claims, 13 Drawing Sheets

U.S. PATENT DOCUMENTS

| | | | | | |
|---|---|---|---|---|---|
| 4,589,137 | A | | 5/1986 | Miller | 381/94 |
| 4,602,337 | A | | 7/1986 | Cox | 364/480 |
| 4,628,529 | A | | 12/1986 | Borth et al. | 381/94 |
| 4,658,426 | A | | 4/1987 | Chabries et al. | 381/94 |
| 4,718,099 | A | | 1/1988 | Hotvet | 381/68.4 |
| 4,723,294 | A | | 2/1988 | Taguchi | 381/94 |
| 4,759,071 | A | | 7/1988 | Heide | 381/68.4 |
| 4,783,818 | A | | 11/1988 | Graupe et al. | 381/71 |
| 4,802,227 | A | | 1/1989 | Elko et al. | 381/92 |
| 4,912,767 | A | | 3/1990 | Chang | 381/47 |
| 4,939,685 | A | | 7/1990 | Feintuch | 364/724.19 |
| 4,956,867 | A | | 9/1990 | Zurek et al. | 381/94.1 |
| 5,016,280 | A | | 5/1991 | Engelbretson et al. | 381/68 |
| 5,027,306 | A | | 6/1991 | Dattorro et al. | 364/724.1 |
| 5,091,952 | A | | 2/1992 | Williamson et al. | 381/68.2 |
| 5,097,510 | A | | 3/1992 | Graupe | 381/47 |
| 5,111,419 | A | | 5/1992 | Morley, Jr. et al. | 364/724.19 |
| 5,165,017 | A | | 11/1992 | Eddington et al. | 381/68.4 |
| 5,225,836 | A | | 7/1993 | Morley, Jr. et al. | 341/150 |
| 5,233,665 | A | * | 8/1993 | Vaughn et al. | 381/93 |
| 5,263,019 | A | * | 11/1993 | Chu | 381/83 |
| 5,291,525 | A | | 3/1994 | Funderburk et al. | 375/98 |
| 5,305,307 | A | * | 4/1994 | Chu | 381/83 |
| 5,355,418 | A | | 10/1994 | Kelsey et al. | 381/72 |
| 5,357,251 | A | | 10/1994 | Morley, Jr. et al. | 341/172 |
| 5,396,560 | A | | 3/1995 | Arcos et al. | 381/68 |
| 5,402,496 | A | * | 3/1995 | Soli et al. | 381/93 |
| 5,412,735 | A | | 5/1995 | Engebretson et al. | 381/94 |
| 5,473,684 | A | | 12/1995 | Bartlett et al. | 379/387 |
| 5,475,759 | A | | 12/1995 | Engebretson | 381/68.2 |
| 5,500,902 | A | | 3/1996 | Stockham, Jr. et al. | 381/68.4 |
| 5,511,128 | A | | 4/1996 | Lindemann | 381/92 |
| 5,651,071 | A | | 7/1997 | Lindemann et al. | 381/68.2 |
| 5,677,987 | A | * | 10/1997 | Seki et al. | |
| 5,680,467 | A | * | 10/1997 | Hansen | 381/93 |
| 5,689,572 | A | * | 11/1997 | Ohki et al. | 381/94.1 |
| 5,710,820 | A | | 1/1998 | Martin et al. | 381/68.4 |
| 5,794,187 | A | | 8/1998 | Franklin et al. | 704/225 |
| 5,825,898 | A | | 10/1998 | Marash | 381/92 |
| 5,838,801 | A | | 11/1998 | Ishige et al. | 381/68.4 |
| 5,848,171 | A | | 12/1998 | Stockham, Jr. et al. | 381/321 |
| 5,867,581 | A | | 2/1999 | Obara | 381/312 |
| 6,023,517 | A | | 2/2000 | Ishige | 381/315 |
| 6,044,162 | A | | 3/2000 | Mead et al. | 381/312 |
| 6,072,885 | A | | 6/2000 | Stockham, Jr. et al. | 381/321 |
| 6,163,287 | A | | 12/2000 | Huang | 341/143 |

OTHER PUBLICATIONS

Chabries, Douglas M. et al., "Application of Adaptive Digital Signal Processing to Speech Enhancement for the Hearing Impaired", Journal of Rehabilitation Research and Development, vol. 24, No. 4, pp. 65–74.

Chabries, et al., "Noise Reduction by Amplitude Warping in the Spectral Domain in a Model–Based Algorithm", Jun. 11, 1997, Etymotic Update, No. 15.

Crozier, P. M., et al., "Speech Enhancement Employing Spectral Subtraction and Linear Predictive Analysis," 1993, Electronic Letters, 29(12): 1094–1095.

Killion, Mead, "The SIN Report: Circuits Haven't Solved the Hearing–in–Noise Problem," Oct. 1997, The Hearing Journal, vol. 50, No. 20, pp. 28–34.

Sedra, A.S. et al., "Microelectronic Circuits", 1990, Holt Rinehart and Winston, pp. 60–65, 230–239, 900.

Sheikhzadeh, H. et al., "Comparative Performance of Spectral Subtraction and HMM–Based Speech Enhancement Strategies with Application to Hearing Aid Design," 1994, Proc. IEEE, ICASSP, pp. I–13 to I–17.

Yost, William A., "Fundamentals of Hearing, An Introduction, " 1994, Academic Press, Third Edition, p. 307.

Berouti, et al., "Enhancement of Speech Corrupted by Acoustic Noise", Apr. 1979, Proceedings of the IEEE Conference on Acoustics, Speech and Signal Processing, pp. 208–211.

Bustamante et al., "Measurement and Adaptive Suppression of Acoustic Feedback in Hearing Aids", Nicolet Instruments, Madison, Wisconsin, pp. 2017–2020.

Chabries, et al., Application of a Human Auditory Model to Loudness Perception and Hearing Compensation:, 1995, IEEE, pp. 3527–3530.

"Delta–Sigma Overview", Fall 1996, ECE 627, pp. 1–29.

Esterman, Pius, "Feedback Cancellation in Hearing Aids: Results from Using Frequency–Domain Adaptive Filters", Institute for Signal and Information Processing, pp. 257–260.

Etter, et al., "Noise Reduction by Noise–Adaptive Spectral Magnitude Expansion", May 1994, J. Audio Eng. Soc., vol. 42, No. 5, pp. 341–348.

George, E. Bryan, "Single–Sensor Speech Enhancement Using a Soft–Decision/Variable Attenuation Algorithm", 1995, IEEE, pp. 816–819.

Gustafsson, et al., "A Novel Psychoacoustically Motivated Audio Enhancement Algorithm Preserving Background Noise Characteristics", 1998, IEEE, pp. 397–400.

Kaelin, et al., "A digital Frequency–Domain Implementation of a Very High Gain Hearing Aid with Compensation for Recruitment of Loudness and Acoustic Echo Cancellation", 1998, Elsevier Science B.V., Signal Processing 64, pp. 71–85.

Karema, et al., "An Oversampled Sigma–Delta A/D Converter Circuit Using Two–Stage Fourth Order Modulator", 1990, IEEE, pp. 3279–3282.

Kates, James M., "Feedback Cancellation in Hearing Aids: Results from a Computer Simulation",1991, IEEE, Transactions on Signal Processing, vol. 39, No. 3, pp. 553–562.

Kuo, et al., "Integrated Frequency–Domain Digital Hearing Aid with the Lapped Transform", Sep. 10, 1992, Northern Illinois University, Department of Electrical Engineering, 2 pages.

Lim, et al., "Enhancement and Bandwidth Compression of Noisy Speech", 1979 IEEE, vol. 67, No. 12, pp. 1586–1604.

Maxwell, et al., "Reducing Acoustic Feedback in Hearing Aids", 1995, IEEE, Transactions on Speech and Audio Processing, vol. 3, No. 4, pp. 304–313.

Norsworthy, Steven R., "Delta–Sigma Data Converters", IEEE Circuits & Systems Society, pp. 321–324.

Quatieri, et al., "Noise Reduction Based on Spectral Change", MIT Lincoln Laboratory, Lexington, MA, 4 pages.

Riley, et al., "High–Decimation Digital Filters", 1991, IEEE, pp. 1613–1615.

Siqueira, et al., "Subband Adaptive Filtering Applied to Acoustic Feedback Reduction in Hearing Aids", 1997 IEEE, pp. 788–792.

Stockham, Thomas G., Jr., "The Application of Generalized Linearity to Automatic Gain Control", Jun. 1968, IEEE, Transactions on Audio and Electroacoustics, vol. AU–16. No. 2, pp. 267–270.

Virag, Nathalie, "Speech Enhancement Based on Masking Properties of the Auditory System", 1995, IEEE, pp. 796–799.

Wyrsch et al., "Adaptive Feedback Canceling in Subbands for Hearing Aids", 4 pages.

* cited by examiner

SUBBAND ACOUSTIC FEEDBACK CANCELLATION IN HEARING AIDS

BACKGROUND OF THE INVENTION

1. Field of the Invention

The present invention relates to the field of digital signal processing. More particularly, the present invention relates to a method and apparatus for use in acoustic feedback suppression in digital audio devices such as hearing aids.

2. Background

Acoustic feedback, which is most readily perceived as high-pitched whistling or howling, is a persistent and annoying problem typical of audio devices with relatively high-gain settings, such as many types of hearing aids. FIG. 1 is a system model of a prior art hearing aid. The prior art hearing aid model 100 shown in FIG. 1 includes a digital sample input sequence X(n) 110 which is added to a feedback output 125 to form a signal 127 that is processed by hearing loss compensation function G(Z) 130 to form a digital sample input sequence Y(n) 140. As shown in FIG. 1, acoustic leakage (represented by transfer function F(Z) 150) from the receiver to the microphone in a typical hearing aid makes the hearing aid act as a closed loop system. Feedback oscillations occur when the gain G(Z) is increased to a point which makes the system unstable. As known to those skilled in the art, to avoid acoustic feedback oscillations, the gain of the hearing aid must be limited to this point. As a direct result of this limitation, many hearing impaired individuals cannot obtain their prescribed target gains, and low-intensity speech signals remain below their threshold of audibility. Furthermore, even when the gain of the hearing aid is reduced enough to avoid instability, sub-oscillatory feedback interferes with the input signal X(n) and causes the gain of the feedforward transfer function Y(Z)/X(Z) to not be equal to G(z). For some frequencies, Y(Z)/X(Z) is much less than G(z) and will not amplify the speech signals above the threshold of audibility.

Prior art feedback cancellation approaches for acoustic feedback control either typically use the compensated speech signals (i.e., Y(n) 140 in FIG. 1), or add a white noise probe as the input signal to the adaptive filter.

Wideband feedback cancellation approaches without a noise probe are based on the architecture shown in FIG. 2, where like components are designated by like numerals. As shown in the adaptive feedback cancellation system 100 of FIG. 2, a delay 170 is introduced between the output 140 and the feedback path 150. In addition, a wideband feedback cancellation function W(Z) 160 is provided at the output of delay 170, and the output of the wideband feedback cancellation function W(Z) 160 is subtracted from the input sequence X(n) 110. The wideband feedback cancellation function W(Z) 160 is controlled by error signal e(n) 190, which is the result of subtracting the output of the wideband feedback cancellation function W(Z) 160 from the input sequence X(n) 110. Although the technique illustrated in FIG. 2 may sometimes provide an additional 6–10 dB of gain, the recursive nature of this configuration can cause the adaptive filter to diverge. Alternatively, adaptive filtering in the subbands requires fewer taps, operates at a much lower rate, and converges faster in some cases. Moreover, feedback cancellation in the frequency domain seems to work even better than in the subbands. Those skilled in the art understand that some frequency domain cancellations scheme will allow for a 20 dB increase in the stable gain of a behind-the-ear ("BTE") hearing aid device without feedback or noticeable distortion. However such frequency domain schemes require the additional complexity of a Fast Fourier Transform ("FFT") and an Inverse Fast Fourier Transform ("IFFT") in both the forward path and the feedback prediction path.

Feedback cancellation methods using a noise probe are dichotomized based on the control of their adaptation as being either continuous or noncontinuous. FIG. 3 is a block diagram of a prior art continuous adaptive feedback cancellation system 300 with noise probes. As shown in FIG. 3, a noise source N 310 injects noise to the output 315 of the hearing loss compensation function G(Z) 130 at a summing junction 320. The block diagram of a continuous-adaptation feedback cancellation system shown in FIG. 3 may increase the stable gain by 10–15 dB. However, the overriding disadvantage of such a system is that the probe noise is annoying and reduces the intelligibility of the processed speech. Alternatively, in the noncontinuous-adaptation feedback cancellation system illustrated in FIG. 4, the normal signal path is broken and the noise probe 310 is only connected during adaptation. Adaptation is triggered only when certain predetermined conditions are met. However, it is very difficult to design a decision rule triggering adaptation without introducing distortion or annoying noise.

A different feedback cancellation apparatus and method has been recently proposed, comprising a feedback canceller with a cascade of two wideband filters in the cancellation path. This method involves using linear prediction to determine Infinite Impulse Response ("IIR") filter coefficients which model the resonant electro-acoustic feedback path. As known to those skilled in the art, linear prediction is most widely used in the coding of speech, where the IIR-filter coefficients model the resonances of the vocal tract. In this system, the IIR filter coefficients are estimated prior to normal use of the hearing aid and are used to define one of the cascaded wideband filters. The other wideband filter is a Finite Impulse Response ("FIR") filter, and adapts during normal operation of the hearing aid.

SUMMARY OF THE INVENTION

A new subband feedback cancellation scheme is proposed, capable of providing additional stable gain without introducing audible artifacts. The subband feedback cancellation scheme employs a cascade of two narrow-band filters $A_i(Z)$ and $B_i(Z)$ along with a fixed delay, instead of a single filter $W_i(Z)$ and a delay to represent the feedback path in each subband. The first filter, $A_i(Z)$, is called the training filter, and models the static portion of the feedback path in $i^{th}$ subband, including microphone, receiver, ear canal resonance, and other relatively static parameters. The training filter can be implemented as a FIR filter or as an IIR filter. The second filter, $B_i(Z)$, is called a tracking filter and is typically implemented as a FIR filter with fewer taps than the training filter. This second filter tracks the variations of the feedback path in the $i^{th}$ subband caused by jaw movement or objects close to the ears of the user.

DETAILED DESCRIPTION OF THE PREFERRED EMBODIMENTS

Figure 1:
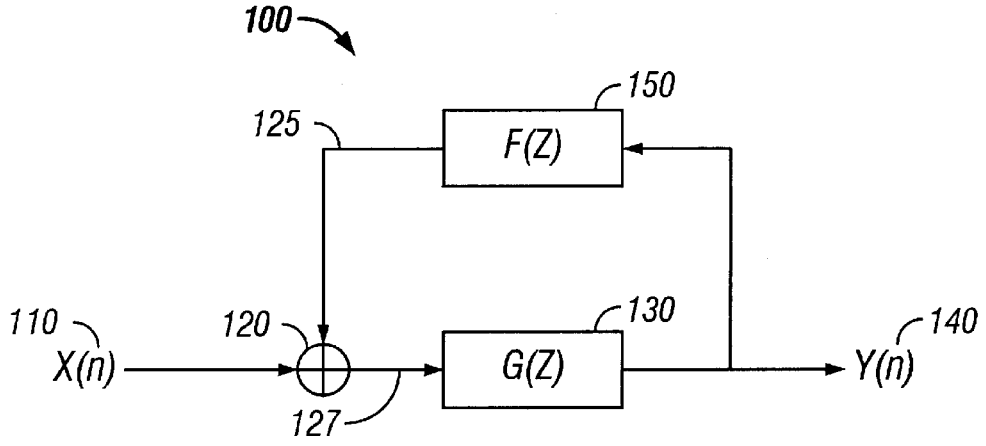
FIG. 1 (Prior Art)
FIG. 1 is a system model of a prior art hearing aid.
Figure 2:
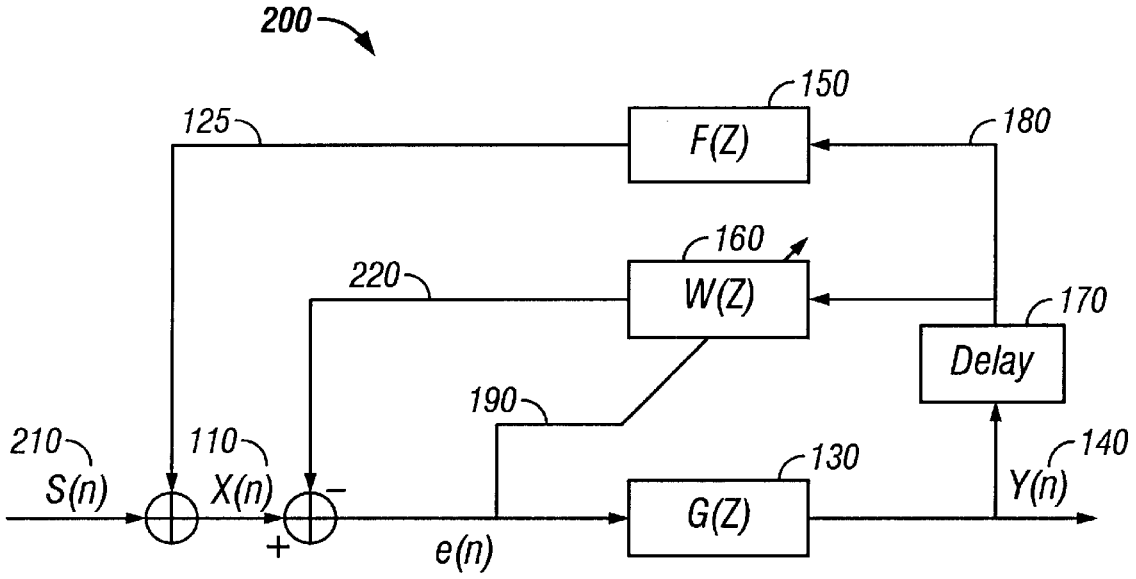
FIG. 2 (Prior Art)
FIG. 2 is a block diagram of a prior art adaptive feedback cancellation system without noise probes.
Figure 3:
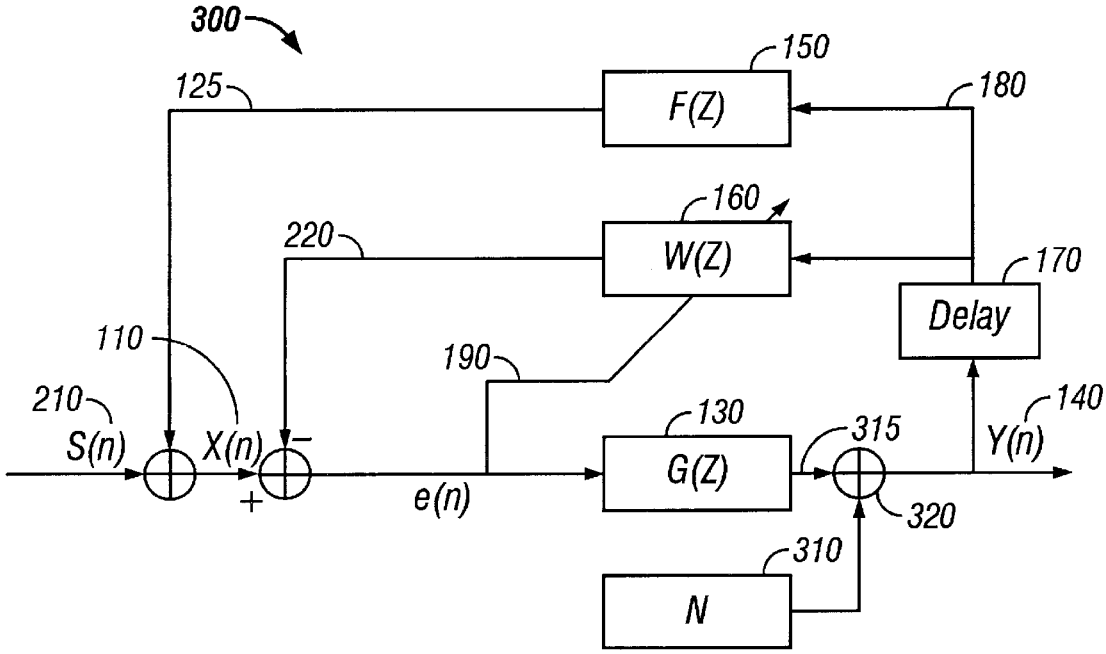
FIG. 3 (Prior Art)
FIG. 3 is a block diagram of a prior art continuous adaptive feedback cancellation system with noise probes.
Figure 4:
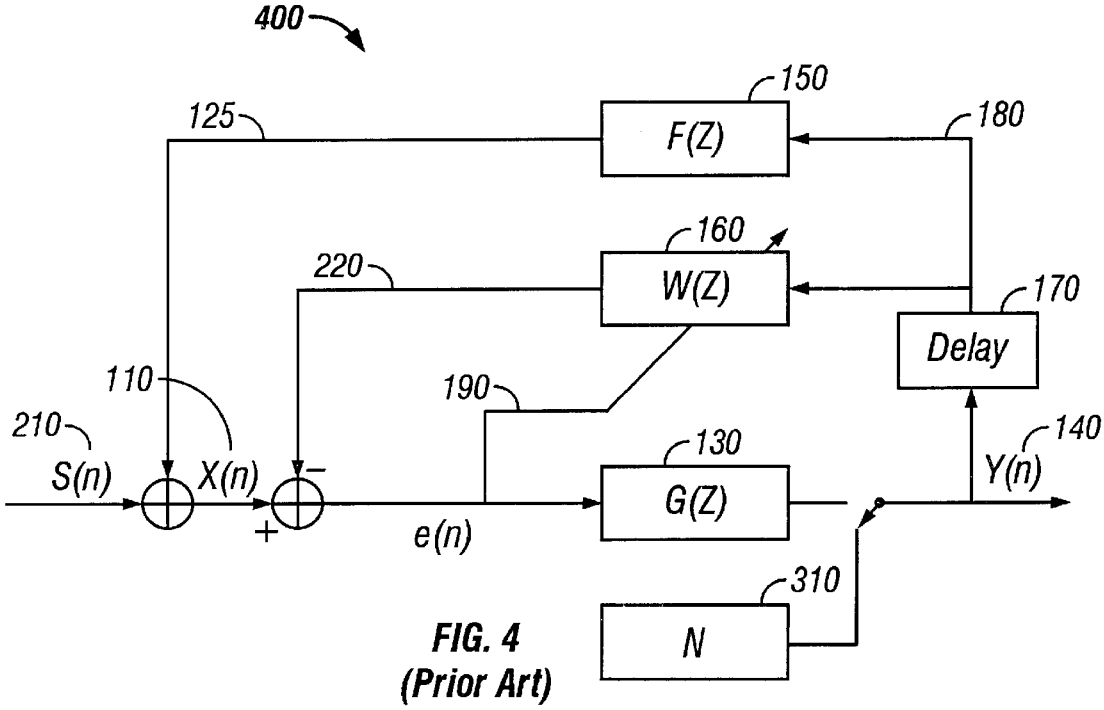
FIG. 4 (Prior Art)
FIG. 4 is a block diagram of a prior art noncontinuous adaptive feedback cancellation system with noise probes.

Those of ordinary skill in the art will realize that the following description of the present invention is illustrative only and not in any way limiting. Other embodiments of the invention will readily suggest themselves to such skilled persons having the benefit of this disclosure.

The present invention discloses a new subband feedback cancellation scheme, capable of providing more than 10 dB of additional stable gain without introducing any audible artifacts. The present invention employs a cascade of two narrowband filters $A_i$ (Z) and $B_i$(Z) along with a fixed delay instead of a single filter $W_i$(Z) and a delay to represent the feedback path in each subband, and where $$W_i(Z)=A_i(Z)B_i(Z)_i.$$

The first filter, $A_i$(Z), is called the training filter, and models the static portion of the feedback path in $i^{th}$ subband, including microphone, receiver, ear canal resonance, and other relatively static model parameters. The training filter can be implemented as either a FIR filter or an IIR filter, but compared with a FIR filter, an IIR filter may need fewer taps to represent the transfer function. However, the IIR adaptive filter may become unstable if its poles move outside the unit circle during the adaptation process. This instability must be prevented by limiting the filter weights during the updating process. In addition, the performance surfaces are generally nonquadratic and may have local minima. Most importantly, only a few taps are needed for an FIR filter to represent the feedback path in subbands, and thus an IIR filter does not provide any computational benefits in subbands. Therefore, due to the disadvantages of an IIR adaptive filter, the FIR adaptive filter is usually applied in subbands.

The second filter, $B_i$(Z), is called a tracking filter and is usually chosen to be a FIR filter with fewer taps than the training filter. It is employed to track the variations of the feedback path in the $i^{th}$ subband caused by jaw movement or objects close to the ears of a user. If subband variations in the feedback path mainly reflect changes in the amount of sound leakage, the tracking filter only needs one tap. Experimentation indicates that this is a good assumption.

The feedback cancellation algorithm according to embodiments of the present invention performs feedback cancellation in two stages: training and tracking. The canceller is always set to the tracking mode unless pre-defined conditions are detected. Without limitation, such conditions may include power-on, switching, training commands from an external programming station, or oscillations.

Because the hearing aid's canceller must initially be trained before it attempts to track, the tracking filter $B_i$(Z) is constrained to be a unit impulse while $A_i$(Z) is being estimated using adaptive signal processing techniques known to those skilled in that art. Training is performed by driving the receiver with a very short burst of noise. Since the probe sequence is relatively short in duration (~300 ms), the feedback path will remain stationary. Furthermore, since the probe sequence is not derived from the microphone input, the configuration of the adaptive system is open loop, which means that the performance surface is quadratic and the coefficients of the filter will converge to their expected values quickly.

Once training is completed, the coefficients of $A_i$(Z) are frozen and the hearing aid's canceller switches into tracking mode. The initial condition of the tracking filter is always an impulse. No noise is injected in the tracking mode. In this mode, the system according to embodiments of the present invention operates as a normal hearing aid with the compensated sound signal sent to the receiver used as the input signal to the feedback cancellation filter cascade.

Figure 5:
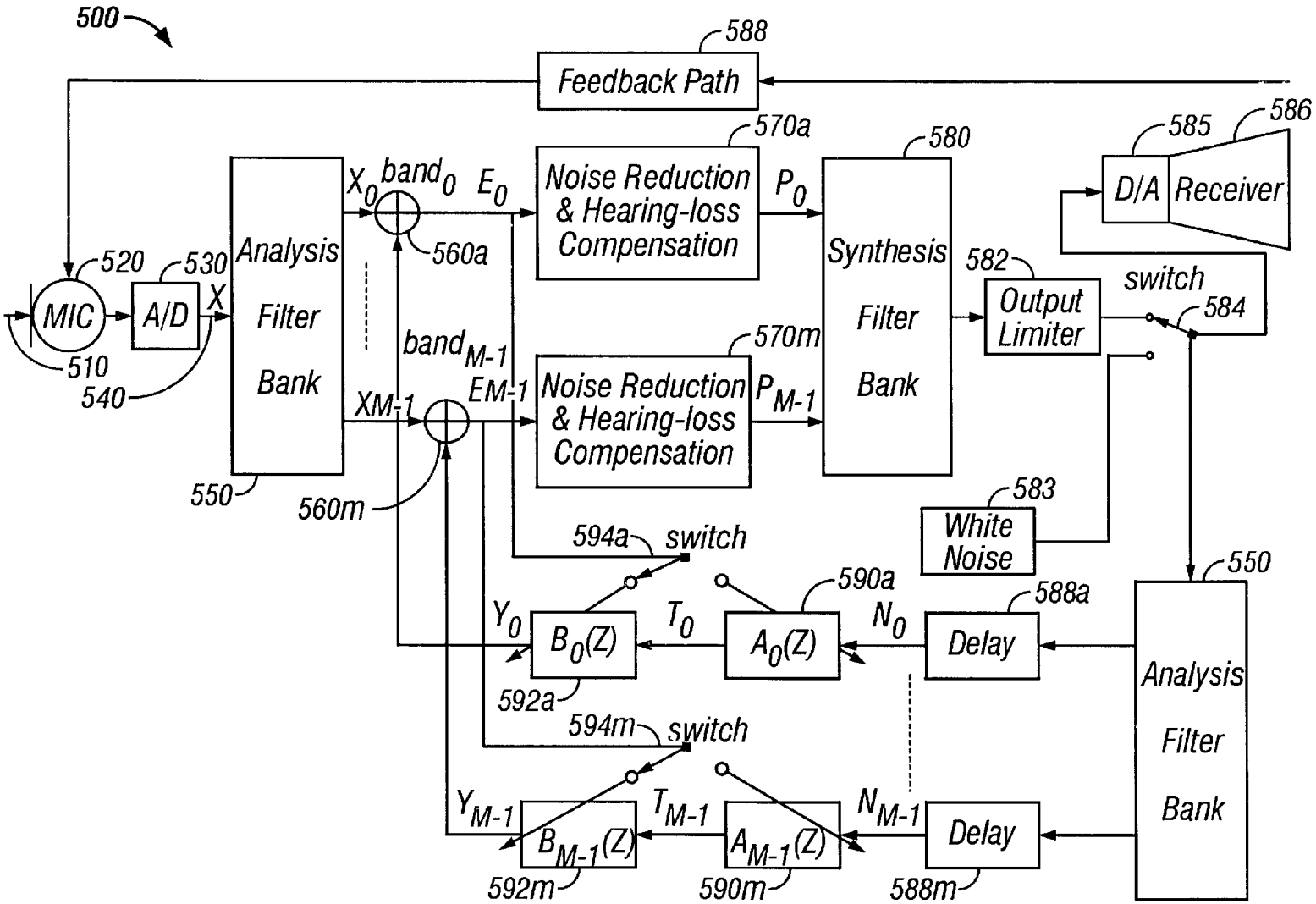
FIG. 5 is a block diagram of a first embodiment of a subband acoustic feedback cancellation system for hearing aids according to the present invention.

FIG. 5 illustrates a first embodiment 500 of the present invention. The microphone 520 and analog-to-digital converter ("A/D") 530 convert sound pressure waves 510 into a digitized audio signal 540. The digital audio signal 540 is further divided into M subbands by an analysis filter bank 550. The same analysis filter bank 550 is also used to divide the feedback path into M subbands. The input to this analysis filter bank is the processed digital audio signal or noise sent to the digital-to-analog converter ("D/A") 585 and receiver 586. At subtractors 560*a*–560*m* the digital audio signal $X_i$ in the $i^{th}$ band subtracts the estimated feedback signal $F_i$ in the corresponding $i^{th}$ band. The subband audio signal $E_i$ is then further processed by noise reduction and hearing loss compensation filters 570*a*–570*m* to reduce the background noise and compensate for the individual hearing loss in that particular band. The processed digital subband audio signals are combined together to get a processed wideband digital audio signal by using a synthesis filter bank 580. The synthesized signal may need to be limited by an output limited 582 before being output to avoid exciting saturation nonlinearities of the receiver. After possible to limiting, the wideband digital audio signal is finally converted back to a sound pressure wave by the D/A 585 and receiver 586.

It should be noted that an output limiting block 582 is shown after the synthesis filter bank 580 in FIG. 5. Although other embodiments of the present invention may or may not include a limiter 582, if one is present, it would typically follow the synthesis filter bank if it is needed to avoid saturation nonlinearities.

Figure 6:
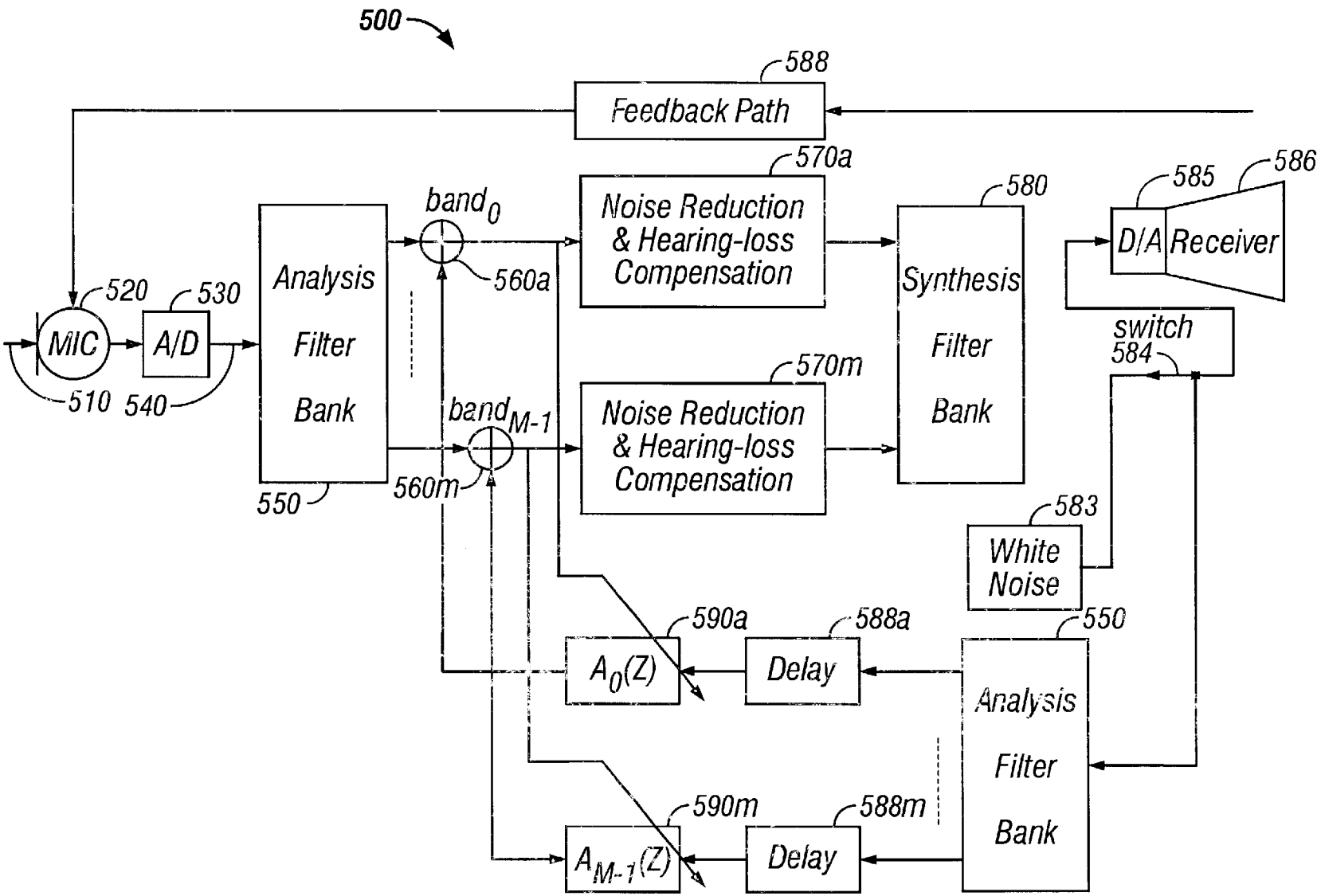
FIG. 6 is a block diagram of a first embodiment of a subband acoustic feedback cancellation system for hearing aids configured for training mode according to aspects of the present invention.
Figure 7:
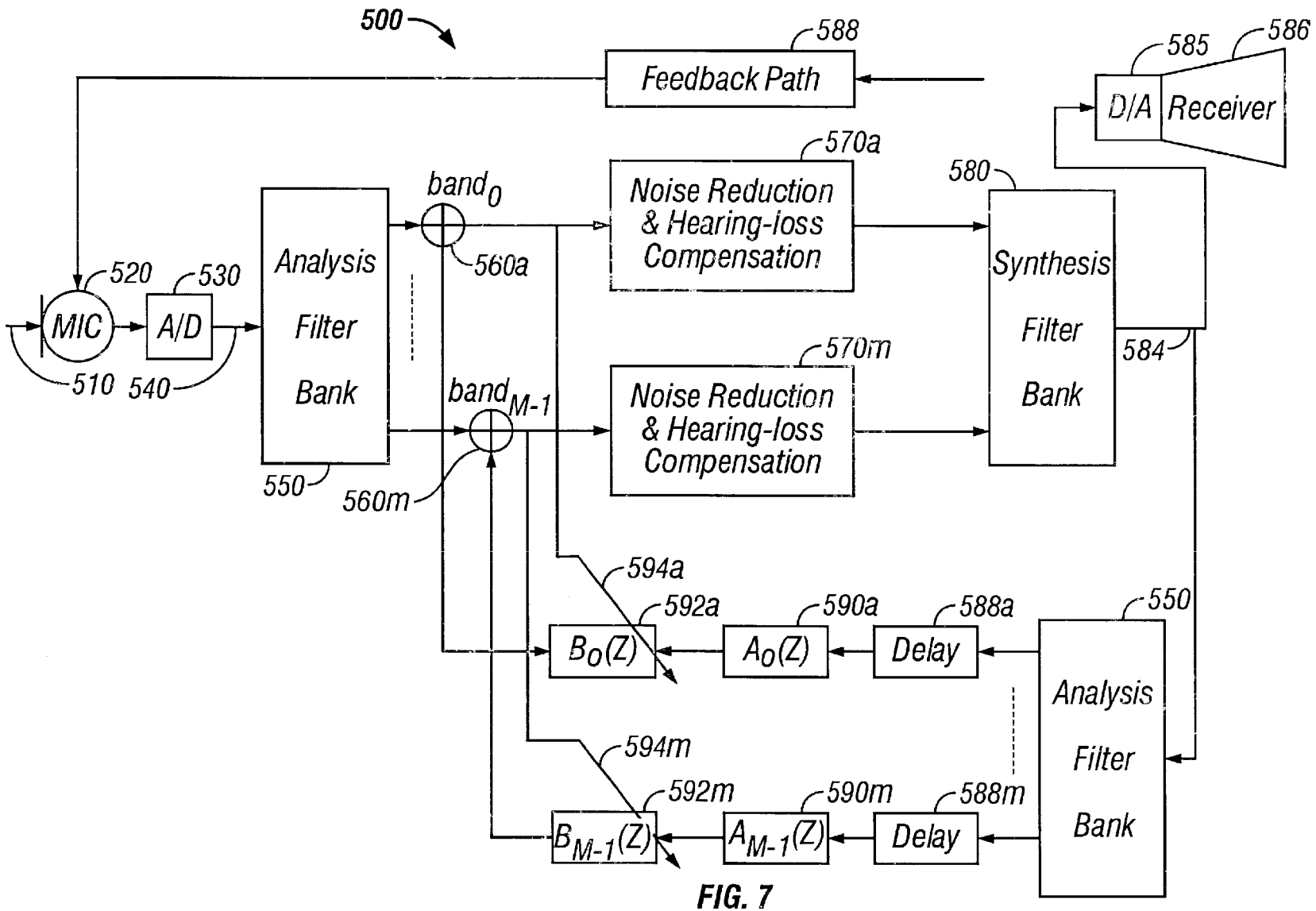
FIG. 7 is a block diagram of a first embodiment of a subband acoustic feedback cancellation system for hearing aids configured for tracking mode according to aspects of the present invention.

The feedback path in each subband is modeled by a cascade of two filters 590 and 592. This feedback cancellation scheme works in two different modes: training and tracking. One filter is adaptively updated only in the training mode, while the other is updated only in the tracking mode. The hearing aid usually works in the tracking mode unless training is required. The position of switches 594*a*–594*m* shown in the FIG. 5 puts the feedback cancellation in either the tracking mode or the normal operation mode of the hearing aid. A block diagram of this embodiment in the tracking mode is illustrated in FIG. 7. To cause the hearing aid to operate in training mode, the switches 594*a*–594*m* are changed to the other position. FIG. 6 illustrates the block diagram of this embodiment in the training mode. Once training is completed, the filter coefficients are frozen, and the hearing aid returns to the tracking mode.

Techniques used to update the filter coefficients adaptively are known to those skilled in the art, and can be directly applied in updating $A_i(Z)$ and $B_i(Z)$ in each subband. Depending on the desired tradeoff between performance and complexity, a signed adaptive algorithm can be used for simpler implementation while more complicated adaptive algorithms, such as the well known NLMS, variable step-size LMS (VS), fast affine projection, fast Kalman filter, fast newton, frequency-domain algorithm, or the transform-domain LMS algorithms can be employed for fast convergence and/or less steady state coefficient variance.

A few techniques specifically useful for the update of the filter coefficients in a subband hearing aid are introduced herein.

First, the attenuation provided by the feedback path 588 may cause the audio output signal in any one subband to fall below the noise floor of the microphone 520 or A/D converter 530. In this case, the subband signal $X_i$ will contain no information about the feedback path. In this subband, the acoustic feedback loop is sufficiently cancelled (the feedback path is broken) and the subband adaptive filter should be frozen. In conjunction with an averager used on a subband version of the audio output, statistics about the attenuation provided by the feedback path can be used to estimate if the subband signal $X_i$ contains any statistically significant feedback components.

Second, the subband source signal additively interferes with the subband feedback signals necessary for identifying the subband feedback path. The ratio of the feedback distorted probe signal to the interfering subband source signal can be considered as the subband adaptive filter's signal-to-noise ratio. During times when this signal-to-noise ratio is low, the adaptive filter will tend to adapt randomly and will not converge. Due to the delays in the feedforward and feedback path, the subband adaptive filter's signal-to-noise ratio will be lowest during the onset of a word Of or other audio input. While the signal-to-noise ratio is low the adaptive filter should be frozen or the step-size of the update algorithm should be reduced. On the other hand, the subband adaptive filter's signal-to-noise ratio will be high during the offset of a word or other audio input. While this signal-to-noise ratio is high the adaptive filter will tend to converge and the update algorithm's step-size should be increased. In conjunction with averagers used on subband versions of the audio output and the audio input, statistics about the attenuation provided by the feedback path can be used to estimate each subband adaptive filter's signal-to-noise ratio.

Third, if the subband hearing aid implements both noise reduction and a feedback canceller which adapts on the feedback-distorted gain-compensated output sound signal then an additional adaptation control can be used. This control is recommended since noise reduction circuitry usually differentiates the subband audio signal $X_i(n)$ into a short-term stationary and a long-term stationary component. The short-term stationary component is considered to be the desired audio signal and the long-term stationary component is deemed to be unwanted background noise. The ratio of the power in the short-term stationary as compared to the long-term stationary sound signal is called the signal-to-noise ratio of the subband audio signal. If the subband signal's statistics indicate that this signal-to-noise ratio is low then the noise reduction circuit will lower the gain in that subband. The lower gain may prevent feedback, but will also reduce the energy of the subband audio output signal. Since this audio output helps to probe the feedback path during tracking, lower gain results in poorer tracking performance. This is especially true if the subband audio input $X_i(n)$ is largely composed of long-term stationary background noise which carries no information about the feedback path. This background noise will interfere with the feedback-distorted gain-compensated output sound signal and produce random variations in the transfer function of $B_i(Z)$. To avoid these random variations the step-size should be reduced (probably to zero). Furthermore, when the signal-to-noise ratio of the subband audio signal is very high it is more likely to be cross-correlated with the feedback-distorted gain-compensated output sound signal. In this case adaptation of the canceller will have an unwanted bias. A decorrelating delay in the feedforward path should be large enough to continue adaptation in this case, but the update algorithm's step-size can be reduced to avoid the influence of the bias.

Fourth, the NLMS and VS algorithms are both simple variations of the LMS algorithm which increase the convergence speed of the canceller. The NLMS algorithm is derived to optimize the adaptive filter's instantaneous error reduction assuming a highly correlated probe sequence. Since for tracking the probe sequence is preferably speech and since speech is highly correlated the NLMS is known to have a practical advantage. On the other hand, the VS algorithm is based on the notion that the optimal solution is nearby when the estimates of the error surface's gradient are consistently of opposite sign. In this case the step-size is decreased. Likewise, if the gradient estimates are consistently of the same sign it is estimated that the current coefficient value is far from the optimal solution and the step size is increased. In feedback cancellation the non-stationarity of the feedback path will cause the optimal solution to change dynamically. Since they operate on different notions, and since they perfectly fit the problems associated with using the conventional LMS algorithm for feedback cancellation a combined NLMS-VS scheme is suggested. The NLMS algorithm will control the step-size on a sample-by-sample basis to adjust for the signal variance and the VS algorithm will aperiodically compensate for changes in the feedback path.

Below, the conventional LMS adaptive algorithm is employed as an example to derive updating equations. It should be very straight-forward to apply other adaptive algorithms to estimate the training filter or the tracking filter. The estimation process of the subband transfer function using the conventional LMS algorithm in two modes is described by the following equations:

Training:

$$i=0, \ldots, M-1$$

$$T_i(n)=A_i^H(n)\, N_i(n),$$

$$e_i(n)=X_i(n)-T_i(n),$$

$$A_i(n+1)=A_i(n)+\mu e^*_i(n)\ N_i(n).$$

Tracking:

$$i=0, \ldots ,M-1$$

$$T_i(n)=A_i^T(n)\ N_i(n),$$

$$e_i(n)=X_i(n)-B_i^H(n)T_i(n),$$

$$B_i(n+1)=B_i(n)+\mu e_i^*(n)\ T_i(n).$$

where $A_i(n)$ is the coefficient vector of the training filter in the $i^{th}$ band, and $N_i,(n)$ is an input vector of the training filter in the corresponding band. The variable $\mu$ is the step size, and $B_i(n)$ is the coefficient vector of the subband tracking filter.

To describe the static feedback path, the corresponding wideband training filter A(Z) usually requires more than 64 taps. If the analysis filter bank decomposes and downsamples the signal by a factor of 16, as in some embodiments of the present invention, the training filter in each subband only requires 4 taps and a fixed delay such as delays 588*a*–588*m* shown.

As described earlier, the signal used to update the coefficient vector $B_i(n)$ is processed speech rather than white noise. Due to the non-flat spectrum of speech, the corresponding spread of the eigenvalues in the autocorrelation matrix of the signal tends to slow down the adaptation process. Since white noise may be desirable under other circumstances, a white noise generator 583 is provided and can be selectively switched by switch 584.

Moreover, the subband adaptive filter's signal-to-noise ratio is usually low, and thus the correlation between the subband audio source signal and the feedback-distorted gain-compensated output sound signal is likely to be high. Also, the system in the tracking mode is recursive, and the performance surface may have local minima. These considerations dictate that the tracking filter should be as short as possible, while still providing an adequate number of degrees of freedom to model the subband variations of the feedback path.

If subband variations in the feedback path mainly reflect changes in the amount of sound leakage, the tracking filter only needs one tap. If this tap is constrained to be real, the filter simplifies nicely to an Automatic Gain Control ("AGC") on the training filter's subband feedback estimate. Even with only a single real tap for tracking in each subband, the recursive nature of the system implies that instability is a possibility if the signal-to-noise ratio is very low, if the correlation between input and output is too high, or if the feedback path changes drastically. Moreover, even if the adaptive canceller remains stable the recursive system may exhibit local minima. To avoid instability and local minima, the coefficients of the tracking filter should be limited to a range consistent with the normal variations of the feedback path. As known to those skilled in the art, methods of limiting the tap may involve resetting or temporarily freezing the tracking filter if it goes out of bounds.

Figure 8:
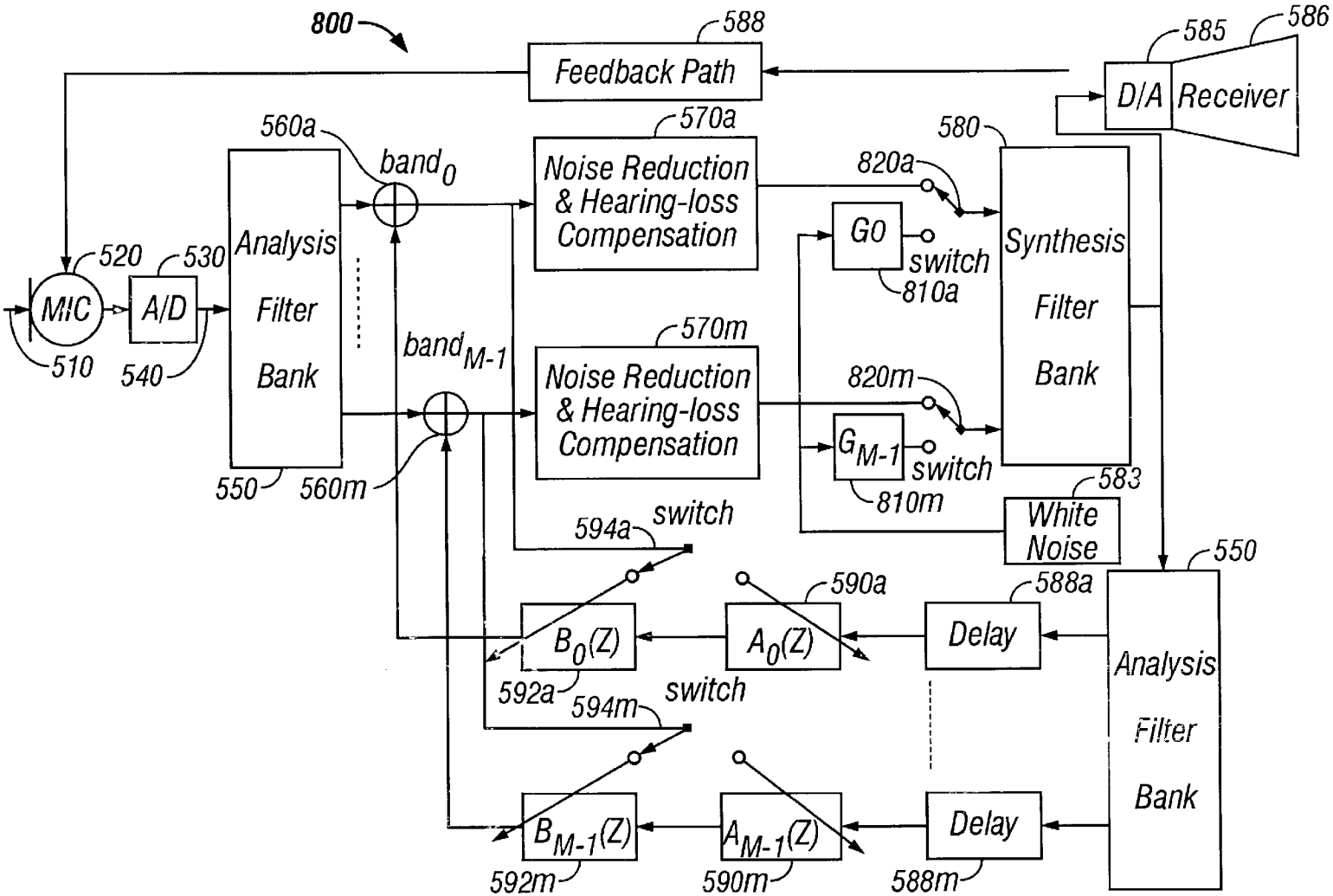
FIG. 8 is a block diagram of a second embodiment of a subband acoustic feedback cancellation system for hearing aids according to the present invention.

FIG. 8 illustrates a second embodiment 800 of the present invention. This embodiment has the same feedback cancellation scheme except that it uses a different mechanism to inject the noise for training. Specifically, as shown in FIG. 8, the white noise generator 583 is processed by a parallel bank of filters 810*a*–810*m* which match the spectral characteristics of the noise signal in each subband to the frequency range of the subband. The processed white noise is selectively switched by switches 820*a*–820*m*. Since the injected noise is often detected by the hearing impaired user, its duration and intensity should be minimized. Experiments have demonstrated that the training filter's speed of convergence is proportional to the average level of the injected noise. It was also observed that since white noise is spectrally unbiased, it is the most suitable type of noise for training. However, the analysis filter bank spectrally shapes any input, which means that white noise injected into the final digital audio output (as shown in FIG. 5) will be colored upon reaching the adaptive filter input.

Figure 9:
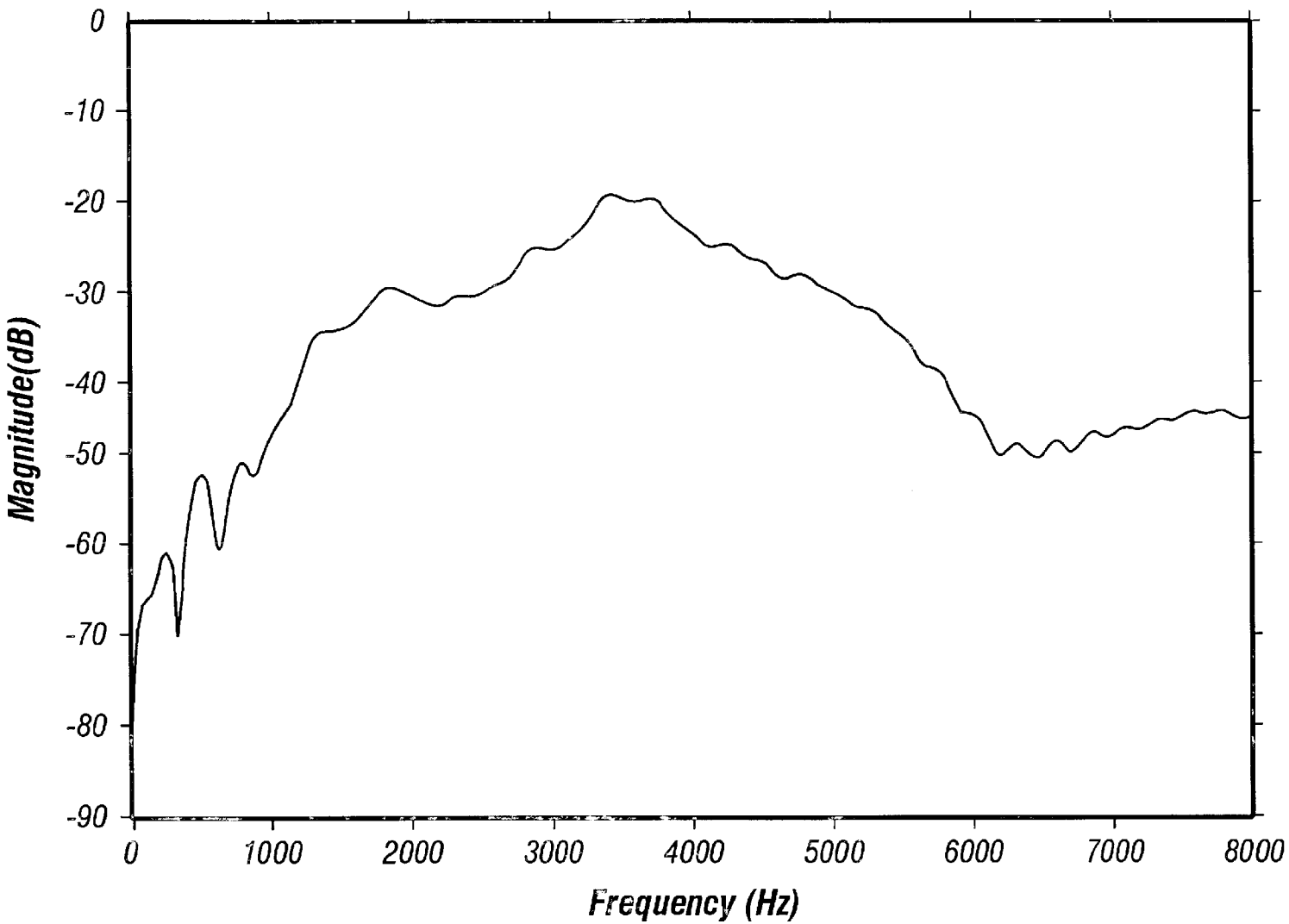
FIG. 9 is a frequency response graph of the feedback path of a BTE hearing aid in the open air according to aspects of the present invention.

Furthermore, as illustrated in the frequency response graph of FIG. 9, the feedback path does not provide equal attenuation across the frequency spectrum. Typically, the largest attenuation occurs in the low and high frequency regions. The attenuation in these regions dictates the intensity of noise required for convergence within a specified period of time. For equal convergence, the mid-frequency region (centered around 3–4 kHz) does not require as intense a probe as at the spectral edges. Since listeners are more sensitive to high-intensity sound in the 3–4 kHz range, the intensity of the noise probe here can be reduced. Using statistical data indicating the average amount of attenuation in each subband, an appropriate weighting factor can be derived for the white noise in each subband. Scaling of the subband noise in this way will maximize identification of the feedback path while minimizing annoyance of the hearing aid wearer. (Since the noise burst is short and infrequent, its masking properties need not be considered.)

Figure 10:
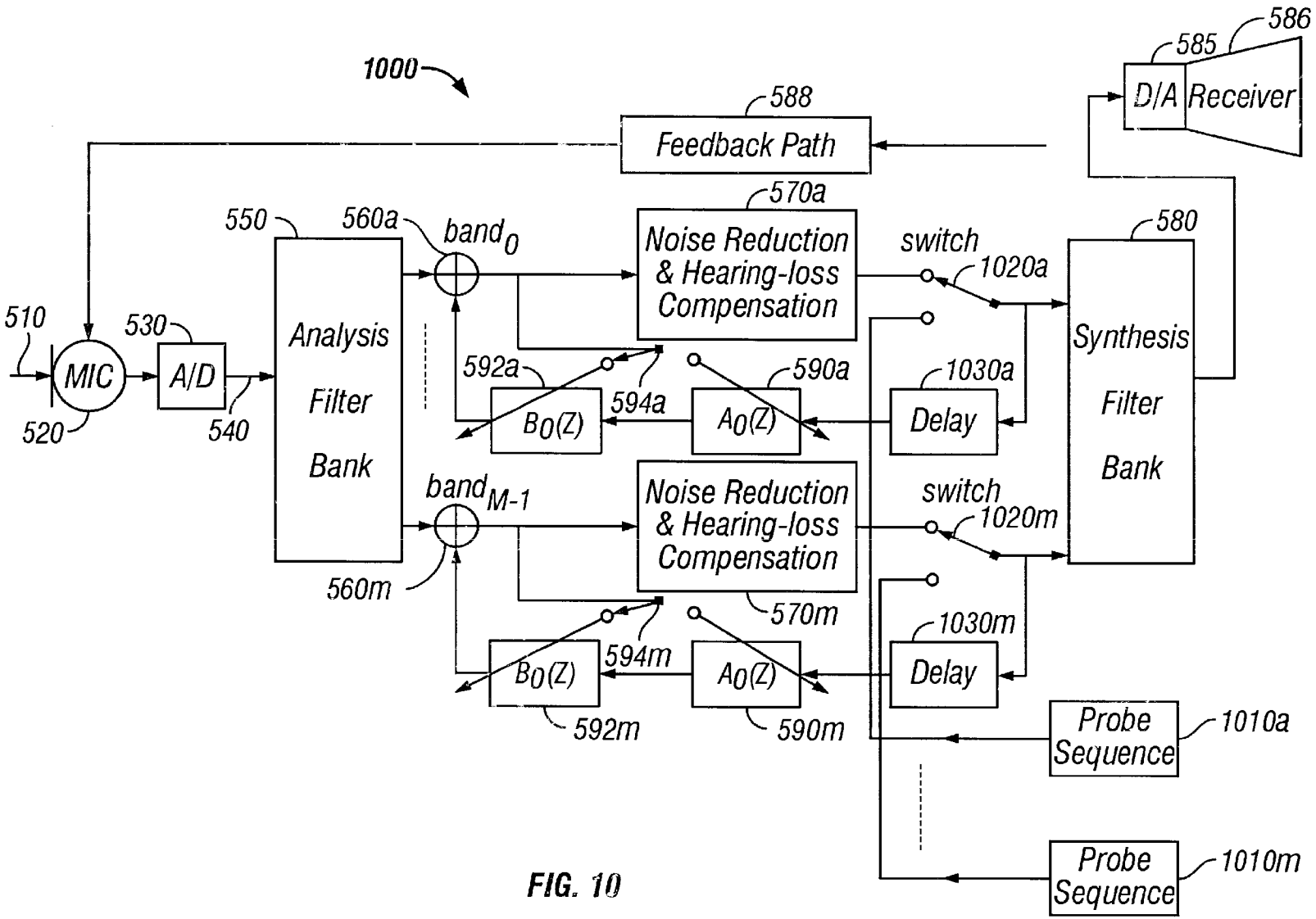
FIG. 10 is a block diagram of a third embodiment of a subband acoustic feedback cancellation system for hearing aids according to the present invention.

FIG. 10 illustrates a third embodiment 1000 of the current invention. As shown in FIG. 10, the cancellation filter takes the filter bank into account so that the feedback cancellation scheme does not require a second analysis filter bank. Instead, probe sequences 1010*a*–1010*m* are selectively switched by switches 1020*a*–1020*m* and delays 1030*a*–1030*m* are utilized as shown. In the third embodiment 1000, as known to those skilled in the art, the training filter needs more taps and crosstalk must be negligible.

Figure 11:
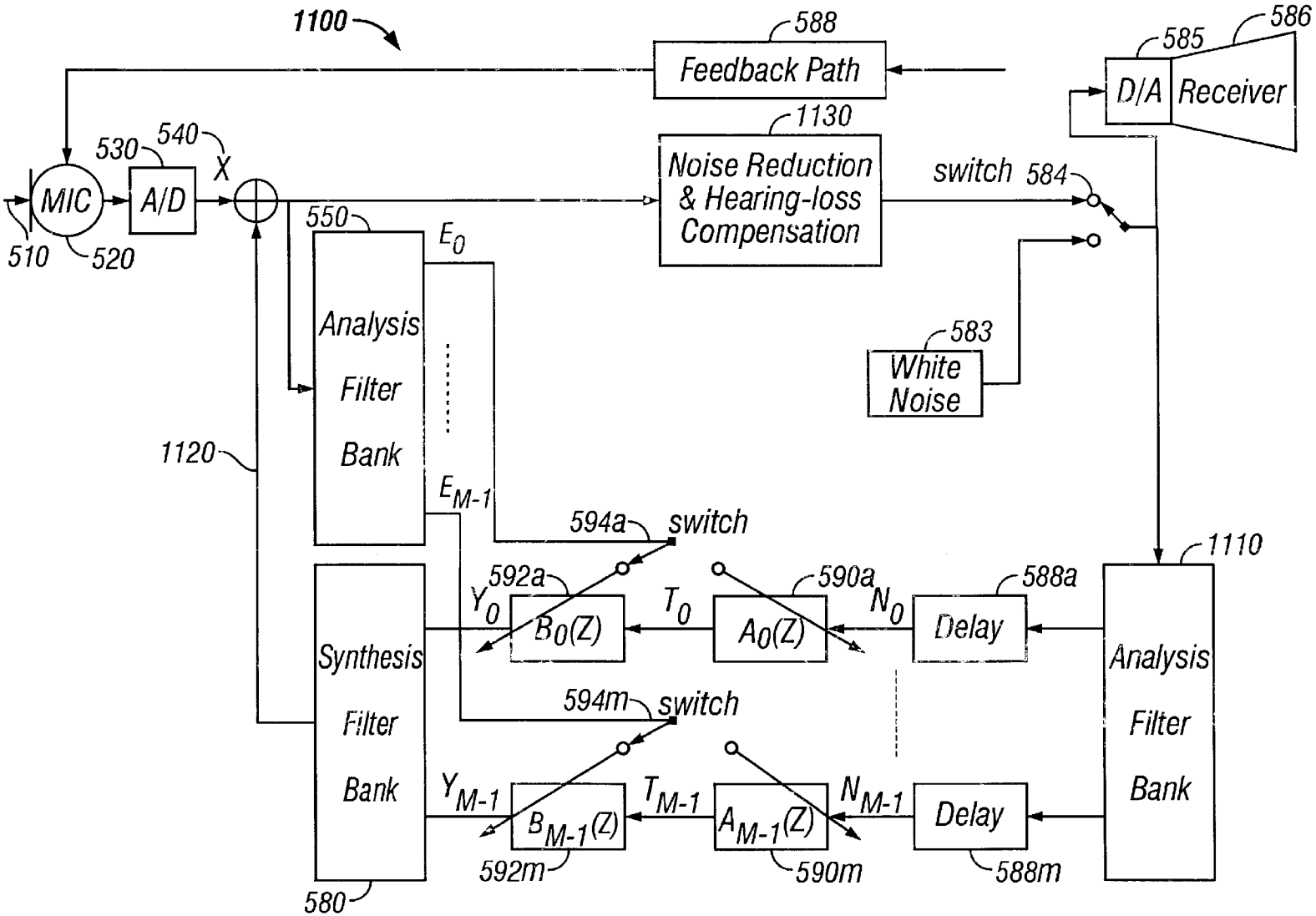
FIG. 11 is a block diagram of a fourth embodiment of a subband acoustic feedback cancellation system for hearing aids according to the present invention.

FIG. 11 illustrates a fourth embodiment 1100 of the current invention. In this implementation, the subband estimates $Y_0$–$Y_{M-1}$ are combined by the synthesis filter bank 580. The combined estimate 1120 is then subtracted from the digitized input X 540 and subsequently filtered through an analysis filter bank 550 to produce the M error signals for the adaptive filters. The advantage of this system over that in FIG. 5 is that the noise reduction and hearing-loss compensation portion of the algorithm could use different analysis filter banks. For example, using two different filter banks 550, 1110 may be useful if it is found that 16 bands are ample for hearing loss compensation while 32 bands are preferred for fine tracking of the feedback path. If the two filter banks 550, 1110 have different delay properties than it may be necessary to insert a bulk delay in the feedforward or feedback path. A second example where this configuration may be useful is if the feedback canceller is used in conjunction with a wideband analog or digital hearing aid. Note that there is only one noise reduction and hearing loss compensation filter 1130 in this embodiment.

Figure 12:
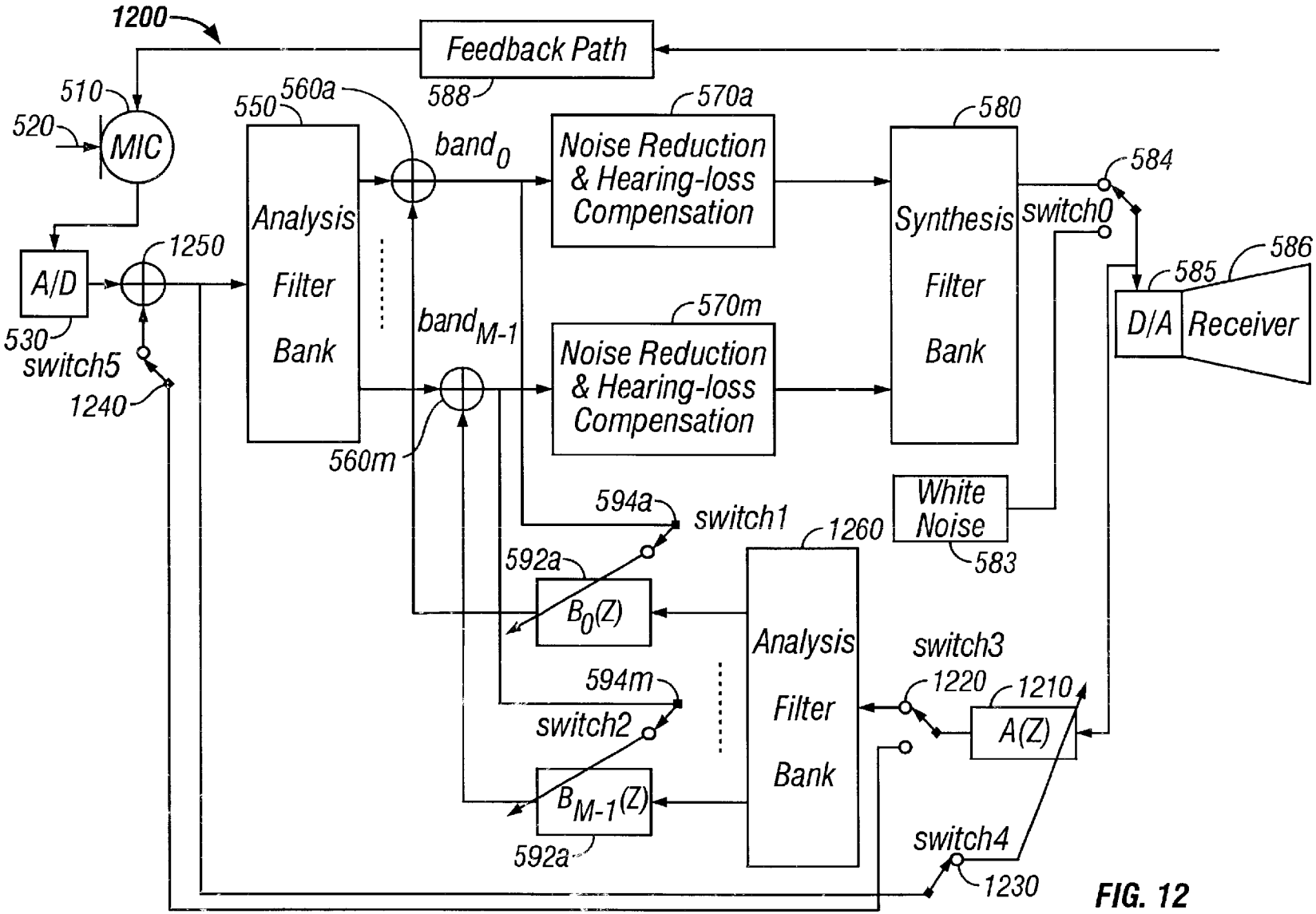
FIG. 12 is a block diagram of a fifth embodiment of a subband acoustic feedback cancellation system for hearing aids according to the present invention.

FIG. 12 illustrates a fifth embodiment 1200 of the current invention. In this embodiment, the training filter 1210 is implemented in the wideband. The advantage of this approach is that shaping of the probe sequence by the analysis filter bank 550 is circumvented. Thus the adaptive filter's input can be white, and convergence will be quick even with the conventional LMS algorithm. The drawback is that the training filter 1210 must be operated at the high rate instead of the decimated rate. By way of a switch 1220, the training filter 1210 is either connected to a second analysis filter bank 1260 or to an input summing junction 1250 through switch 1240. Further, the training filter 1210 may receive a second input signal through switch 1230.

As mentioned previously, a common problem in using a noise signal 583 as the training signal for an adaptive feedback canceller is that it must be a very low-level signal so that it is not unpleasant to the listener. However, a low-level training signal can be overwhelmed by ambient sounds so that the signal-to-noise ratio for the training signal can be very low. This can cause poor training results.

To overcome the problem of low signal-to-noise ratio for the training signal, one can take advantage of the fact that the probe sequence is periodic. First, a relatively short sequence is chosen, but one that is longer than the longest feedback component. Then, the output sequence Y(n) 1395 is synchronously detected after it has passed through the feedback path (1392, 1398, 588, and 1325) and combined 1320 with the input sequence S(n) 1310 to produce X(n) 1330. Corresponding samples within the sequence are averaged. For example, the first samples from each period of the sequence are averaged together. Likewise, second samples are averaged together, and so forth. Two commutators 1340 and 1360 and a set of averagers 1350*a*–1350L can be used by those skilled in the art to grow the desired sequence. The desired sequence is subtracted 1370 from the output 1375 of a training filter A(Z) 1390 to produce an error estimate e(n) 1380.

Figure 13:
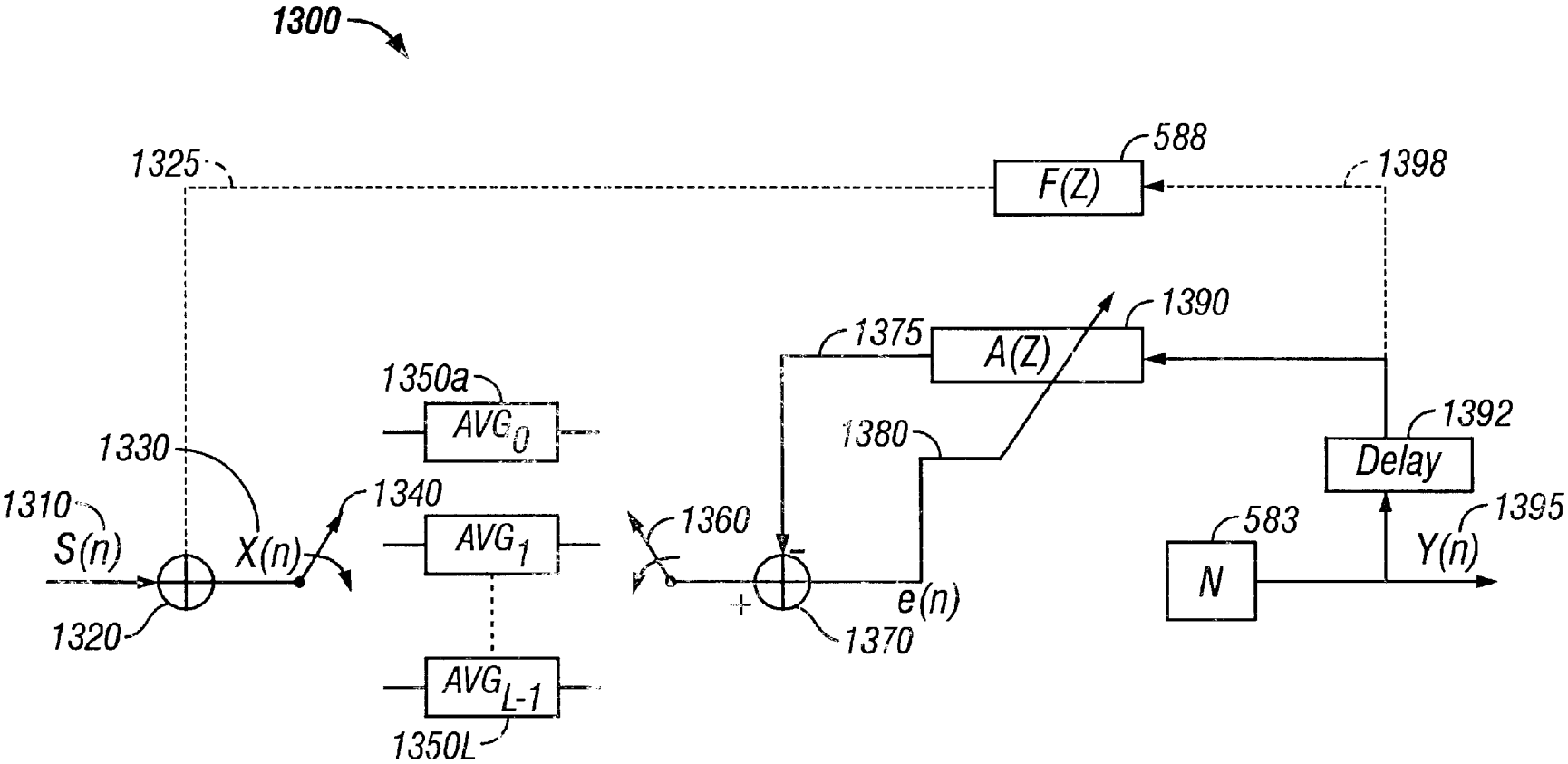
FIG. 13 is a block diagram of adaptive feedback cancellation with averaging of a cyclical noise probe according to aspects of the present invention.

Averaging periods of the sequence together will increase the amplitude of the training signal and simultaneously reduce the amplitude of the ambient sounds assuming that the ambient sound is zero-mean. The averaged sequence will grow to the probe sequence distorted by the feedback path. The averaged sequence becomes the desired signal (X[n]–S[n]) of the adaptive structure. The probe sequence is filtered by the adaptive filter that grows an estimate of the feedback distortion. The configuration for training in the wideband is shown in FIG. 13, where the variable L represents the length of the probe sequence.

Additionally, if the ambient sounds are expected to fluctuate in amplitude, then the probe sequence can be averaged only during times when the level of the ambient sound is low. This can further improve the signal-to-noise ratio of the adaptive canceller.

Figure 14:
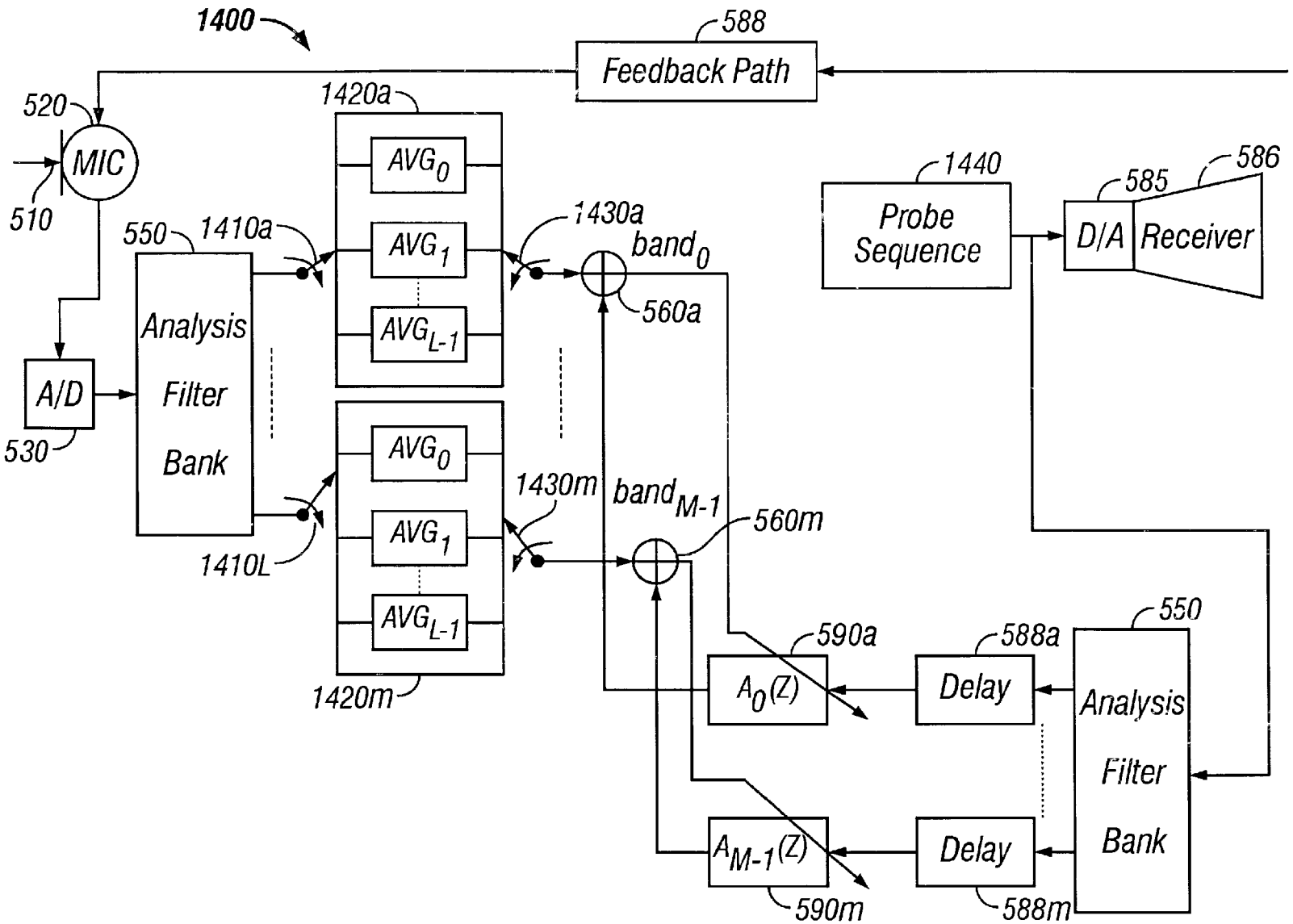
FIG. 14 is a block diagram of feedback cancellation in training mode with averaging of a cyclical noise probe according to aspects of the present invention.

FIG. 14 shows how to do this training in the subbands. Each subband will have a desired sequence of length L. The length of the injected wideband probe sequence will be M*L. Storing the corresponding desired sequence as a set of subband sequences saves power since the averagers (1410*a*–1410*m*, 1420*a*–1420*m*, and 1430*a*–1430*m*) are updated at the downsampled rate.

Finally, since the feedback canceller will be used with individuals who have a hearing loss, it may be possible to inject an attenuated version of the probe sequence 1440 during the normal operation of the hearing aid. By averaging periods of the sequence together, the amplitude of zero-mean feedback-filtered speech will be reduced just like the zero-mean ambient sounds. Thus even when mixed with the normal speech output, the averaged sequence will still represent the training signal distorted by the feedback path. As suggested previously, the averaged sequence should be computed in the subbands to take advantage of the downsampling. To use the averaged subband sequence for updating of the training filter during normal operation of the hearing aid requires a third analysis filter bank and a second set of subband training filters as shown in FIG. 15.

Figure 15:
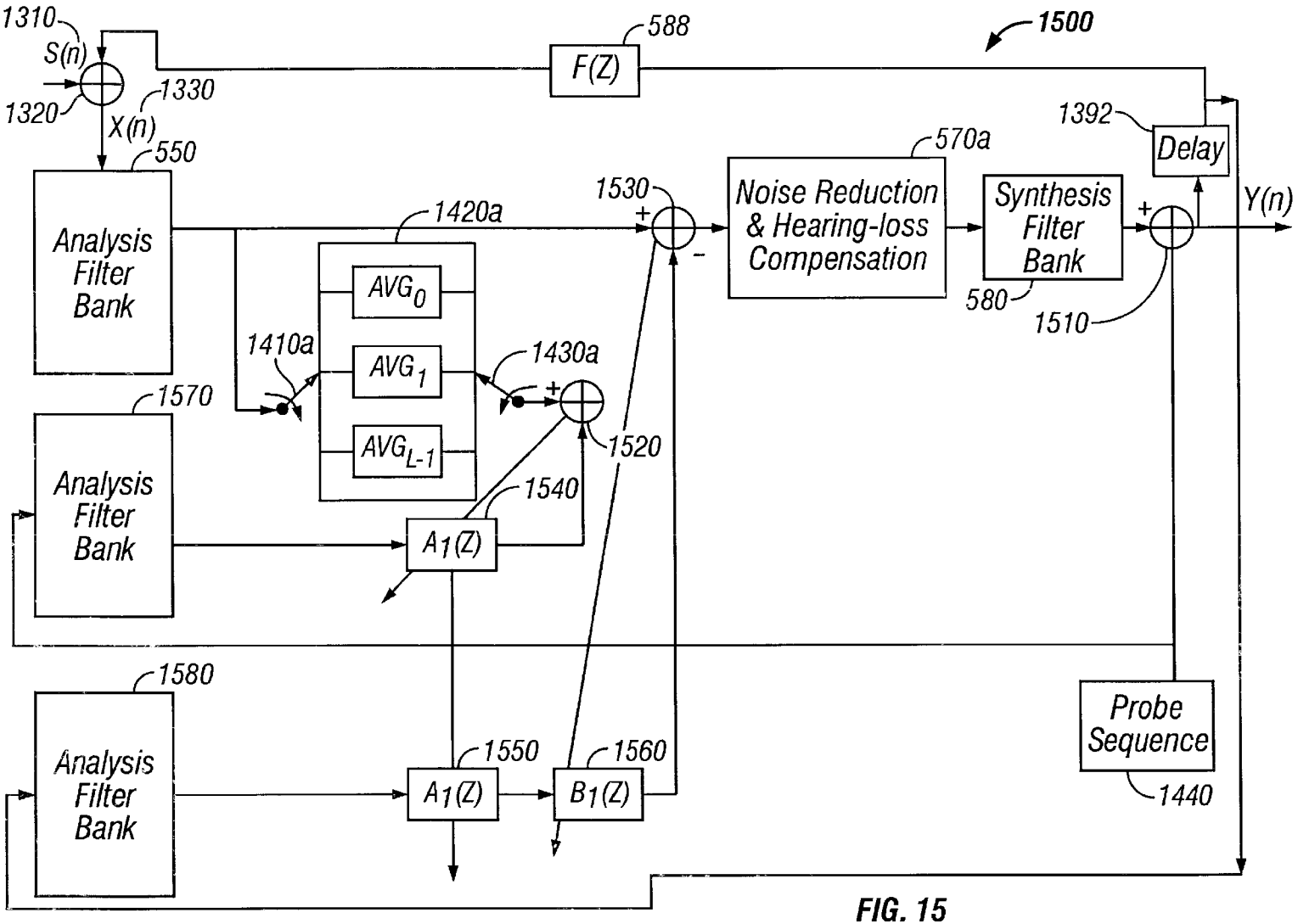
FIG. 15 is a block diagram of a sixth embodiment of a subband acoustic feedback cancellation system for hearing aids according to the present invention.

FIG. 15 illustrates a sixth embodiment 1500 of the current invention. In FIG. 15, only the components for one subband are shown. The components for the rest of the M bands are identical. As shown, the input to the second set of training filters 1540 will be derived by passing the probe sequence 1440 directly through the third analysis filter bank 1570. Likewise, the outputs of the second set of training filters 1540 are synchronously subtracted 1520 from the averaged subband sequences (1410*a*, 1420*a*, and 1430*a*) and used as the error estimates to update the filters 1540. The probe sequence 1440 is also be combined 1510 with the output of the synthesis filter bank 580.

When some pre-specified conditions are met, the coefficients of the second training filter, $A_i(Z)$, 1540 in the $i^{th}$ band are copied into the first training filter, $\hat{A}_i(Z)$ 1550. When this is done, the tracking filter $B_i(Z)$ 1560 should be reset to an impulse. The pre-specified conditions may be if the correlation coefficient between $A_i(Z)$ 1540 and $\hat{A}_i(Z)$ 1550 falls below a threshold, if a counter triggers a scheduled update, or if feedback oscillations are detected. The first training filter in the $i^{th}$ band, $\hat{A}_i(Z)$ 1550, can be initially adapted as shown in FIG. 6 or FIG. 14. The input to the first training filter 1550 is the output of the second analysis filter 1580. The output of the tracking filter 1560 is subtracted 1530 from the output of the analysis filter 550 and used as the error estimates to update the tracking filter 1560. This new configuration will help the feedback canceller follow changes in the average statistics of the feedback path without interrupting the normal audio stream and without introducing distortion noticed by the hearing impaired individual.

Compared with the existing feedback cancellation approaches, this invention is simpler and easier to implement. It is well-suited for use with a digital subband hearing aid. In addition, embodiments of the present invention can provide more than 10 dB of additional gain without introducing distortion or audible noise.

While embodiments and applications of this invention have been shown and described, it would be apparent to those of ordinary skill in the art having the benefit of this disclosure that many more modifications than mentioned above are possible without departing from the inventive concepts herein. The invention, therefore, is not to be restricted except in the spirit of the appended claims.

What is claimed is:

1. A method for canceling acoustic feedback in hearing aids, comprising the steps of:

digitizing an input audio signal into a sequence of digital audio samples;

splitting said sequence of digital audio samples into a plurality of subband signals;

processing each of said plurality of subband signals separately with a noise reduction and hearing loss compensation algorithm into a plurality of processed digital subband audio signals;

combining said plurality of processed digital subband audio signals into a processed wideband digital audio signal;

converting said processed wideband digital audio signal into an output audio signal;

splitting said processed wideband digital audio signal into a plurality of subband feedback signals;

filtering each of said plurality of subband feedback signals with a narrow-band training filter that models the static portion of the feedback path in each of said subbands and provides an output thereof;

filtering each said output of said narrow-band training filter with a narrow-band tracking filter that tracks the variations of the feedback path in each of said subbands, and provides an output thereof, and subtracting said output of each of said narrow-band tracking filters from the corresponding subband signal of said plurality of subband signals.

2. The method according to claim 1, wherein each of said training filters is a Finite Impulse Response ("FIR") filter and each of said tracking filters is a FIR filter.

3. The method according to claim 1, wherein each of said training filters is an Infinite Impulse Response ("IIR") filter and each of said tracking filters is a Finite Impulse Response ("FIR") filter.

4. An apparatus for canceling acoustic feedback in hearing aids, comprising:

an analog to digital converter for digitizing an input audio signal into a sequence of digital audio samples;

a first analysis filter bank for splitting said sequence of digital audio samples into a plurality of subbands, wherein each of said subbands outputs a corresponding subband signal;

a subtractor in each of said subbands that subtracts the output of each of a plurality of narrow-band tracking filters from a corresponding subband signal at the output of said first analysis filter bank;

a digital signal processor in each of said subbands that processes the output of said subtractor with a noise reduction and hearing loss compensation algorithm into a plurality of processed digital subband audio signals;

a synthesis filter bank for combining said plurality of processed digital subband audio signals into a processed wideband digital audio signal;

a digital to analog converter for converting said processed wideband digital audio signal into an output audio signal;

a second analysis filter bank for splitting said processed wideband digital audio signal into said plurality of subbands, wherein each of said subbands outputs a corresponding subband feedback signal;

a narrow-band training filter coupled to each of said plurality of subband feedback signals that models the static portion of the feedback path in each of said subbands and provides an output thereof; and a narrow-band tracking filter coupled to the output of each of said narrow-band training filters that tracks the variations of the feedback path in each of said subbands and provides an output to said subtractor.

5. The apparatus according to claim 4, wherein each of said training filters is a Finite Impulse Response ("FIR") filter and each of said tracking filters is a FIR filter.

6. The apparatus according to claim 4, wherein each of said training filters is an Infinite Impulse Response ("IIR") filter and each of said tracking filters is a Finite Impulse Response ("FIR") filter.

7. The apparatus according to claim 4, further comprising an output limiter coupled to the output of said synthesis filter bank.

8. The apparatus according to claim 7, wherein each of said training filters is a Finite Impulse Response ("FIR") filter and each of said tracking filters is a FIR filter.

9. The apparatus according to claim 7, wherein each of said training filters is an Infinite Impulse Response ("IIR") filter and each of said tracking filters is a Finite Impulse Response ("FIR") filter.

10. The apparatus according to claim 7, further comprising a multiplexing switch coupled to the input of said digital to analog converter, wherein said multiplexing switch selectively couples either the output of said output limiter or the output of a noise generator to the input of said digital to analog converter.

11. The apparatus according to claim 10, wherein each of said training filters is a Finite Impulse Response ("FIR") filter and each of said tracking filters is a FIR filter.

12. The apparatus according to claim 10, wherein each of said training filters is an Infinite Impulse Response ("IIR") filter and each of said tracking filters is a Finite Impulse Response ("FIR") filter.

13. The apparatus according to claim 10, further comprising a delay element coupled to the input of each of said training filters and coupled to one of the plurality of outputs of said second analysis filter bank.

14. The apparatus according to claim 13, wherein each of said training filters is a Finite Impulse Response ("FIR") filter and each of said tracking filters is a FIR filter.

15. The apparatus according to claim 13, wherein each of said training filters is an Infinite Impulse Response ("IIR") filter and each of said tracking filters is a Finite Impulse Response ("FIR") filter.

16. The apparatus according to claim 4, further comprising a multiplexing switch coupled to the input of said digital to analog converter, wherein said multiplexing switch selectively couples either the output of said synthesis filter bank or the output of a noise generator to the input of said digital to analog converter.

17. The apparatus according to claim 16, wherein each of said training filters is a Finite Impulse Response ("FIR") filter and each of said tracking filters is a FIR filter.

18. The apparatus according to claim 16, wherein each of said training filters is an Infinite Impulse Response ("IIR") filter and each of said tracking filters is a Finite Impulse Response ("FIR") filter.

19. An apparatus for canceling acoustic feedback in hearing aids, comprising:

an analog to digital converter for digitizing an input audio signal into a sequence of digital audio samples;

a first analysis filter bank for splitting said sequence of digital audio samples into a plurality of subbands, wherein each of said subbands outputs a corresponding subband signal;

a subtractor in each of said subbands that subtracts the output of each of a plurality of narrow-band tracking filters from a corresponding subband signal at the output of said first analysis filter bank;

a digital signal processor in each subband that processes output of said subtractor with a noise reduction and hearing loss compensation algorithm into a plurality of processed digital subband audio signals;

a plurality of noise matching filters, wherein each said noise matching filter is associated with one of said processed digital subband audio signals, and wherein said plurality of noise matching filters are stimulated by a noise generator;

a synthesis filter bank having a multiplexing switch coupled to the input of said synthesis filter bank, wherein said multiplexing switch selectively couples either one of said processed digital subband audio signals or the output of the corresponding noise matching filter to the input of said synthesis filter bank, and wherein said synthesis filter bank combines either said processed digital subband audio signals into a processed wideband digital audio signal or the outputs of said noise matching filters into a processed wideband digital audio signal;

a digital to analog converter for converting said processed wideband digital audio signal into an output audio signal;

a second analysis filter bank for splitting said processed wideband digital audio signal into said plurality of subbands, wherein each of said subbands outputs a corresponding subband feedback signal;

a narrow-band training filter coupled to each of said plurality of subband feedback signals that models the static portion of the feedback path in each of said subbands and provides an output thereof; and a narrow-band tracking filter coupled to the output of each of said narrow-band training filters that tracks the variations of the feedback path in each of said subbands and provides an output to said subtractor.

20. The apparatus according to claim 19, wherein each of said training filters is a Finite Impulse Response ("FIR") filter and each of said tracking filters is a FIR filter.

21. The apparatus according to claim 19, wherein each of said training filters is an Infinite Impulse Response ("IIR") filter and each of said tracking filters is a Finite Impulse Response ("FIR") filter.

22. The apparatus according to claim 19, further comprising a delay element coupled to the input of each of said training filters and coupled to one of the plurality of outputs of said second analysis filter bank.

23. The apparatus according to claim 22, wherein each of said training filters is a Finite Impulse Response ("FIR") filter and each of said tracking filters is a FIR filter.

24. The apparatus according to claim 22, wherein each of said training filters is an Infinite Impulse Response ("IIR") filter and each of said tracking filters is a Finite Impulse Response ("FIR") filter.

* * * * *